United States Patent [19]

Wakamiya

[11] 4,368,034

[45] Jan. 11, 1983

[54] HEATING CONTROL METHOD FOR CONTINUOUSLY HEATING FURNACE

[75] Inventor: Yoshinori Wakamiya, Nishinomiya, Japan

[73] Assignee: Mitsubishi Denki Kabushiki Kaisha, Tokyo, Japan

[21] Appl. No.: 269,666

[22] Filed: Jun. 2, 1981

[30] Foreign Application Priority Data

Jun. 4, 1980 [JP] Japan ..... 55-75902

[51] Int. Cl.[3] ..... F27D 3/00; F27B 9/40; C21B 7/24

[52] U.S. Cl. ..... 432/11; 266/80; 432/37

[58] Field of Search ..... 432/11, 18, 36, 37; 266/78, 80

[56] References Cited

U.S. PATENT DOCUMENTS 3,604,695 9/1971 Steeper ..... 432/11
4,255,133 3/1981 Tauifuji et al. ..... 432/36

FOREIGN PATENT DOCUMENTS 48-50776 7/1973 Japan .

*Primary Examiner*—John J. Camby
*Attorney, Agent, or Firm*—Wenderoth, Lind & Ponack

[57] ABSTRACT

For each of three control zones in a furnace, a computer calculates, at time intervals Δt, the heat input to slabs from the actual flow rates of the fuel and air and other stored data through the use of the equation of the thermal equilibrium and then determining the heat input to each slab by apportioning the calculated heat input among the slabs according to its heat content before the Δt. Subsequently, the computer estimates the fuel flow rate after the time interval Δt from a difference between the calculated heat input and an objective heat input and then determining the fuel flow rate through the use of the equation of the thermal equilibrium. For each control zone, a fuel regulator controls the fuel flow rate in response to the estimated flow rate while an air regulator controls an air flow rate in response to an optimum air ratio as determined by the estimated flow rate.

1 Claim, 3 Drawing Figures

HEATING CONTROL METHOD FOR CONTINUOUSLY HEATING FURNACE

BACKGROUND OF THE INVENTION

This invention relates to a method of controlling the heating effected by a continuously heating furnace used in heating slabs or the like.

In order to control the temperature of slabs at a delivery end of a heating furnace by an electronic computer, there has been previously employed a method of controlling a low rate of a fuel within the furnace by determining the temperatures of the slab at their different positions occupied thereby between their charge and delivery through a calculation of the heat transfer made on the basis of the temperature of the atmosphere filling the furnace from the slabs' sizes and time intervals for which the slabs are actually put in the furnace, estimating a time interval for which the slabs are left within the furnace until their delivery from delivery schedules for the individual slabs, and calculating back to the necessary temperature of the atmosphere within the furnace required for the slabs to be put at the desired deliver temperature to thereby put the temperature of the atmosphere within the furnace at the desired delivery temperature.

Conventional control methods such as described above have been disadvantageous in that the control has a low accuracy because the calculation of the heat transfer uses a heat transfer coefficient of the slab which is varied with the position and temperature of the slab within the furnace and the particular temperature profile of a burnt fuel and therefore difficult to be treated as a constant. This poor accuracy has also been because the control methods do not consider the influence of the number of slabs existing in each control zone of the furnace and the actual control is effected by using different magnitudes set to the different slabs. This has resulted also in a poor accuracy of the control.

Accordingly, it is an object of the present invention to provide a new and improved control method of controlling the heating effected by a continuously heating furnace with a high accuracy.

SUMMARY OF THE INVENTION

The present invention provides a method controlling heating effected by a continuously heating furnace divided into a plurality of control zones, comprising the steps of sensing the flow rate of the charged fuel, a flow rate of charged air and the temperature of an exhaust gas at each time point, determining the heat input to slabs at the each time point through the use of the equation of the thermal equilibrium, determing the heat content of each slab within the furnace at the each time point from the heat input to the slabs thus determined, estimating the heat input to the slabs required up to the next succeeding time point from the difference between the determined heat input and an objective heat input to the slabs, estimating the flow rate of the charged fuel by using the equation of the thermal equilibrium, repeating the abovementioned steps with each of the control zones and controlling the flow rate of the charged fuel.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Figure 1:
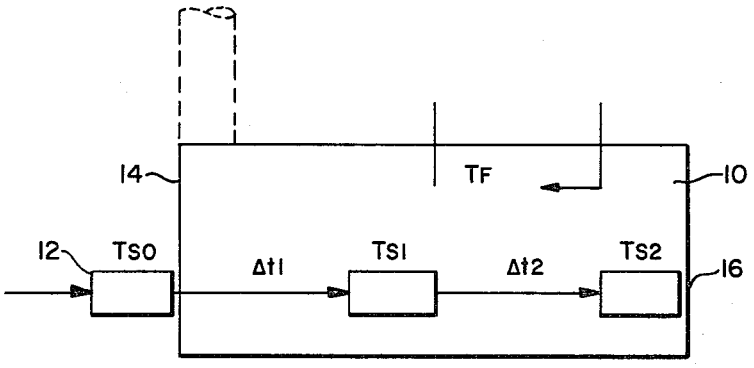
FIG. 1 is a diagram useful in explaining a control method employing a conventional temperature calculation.

Referring now to FIG. 1 of the drawings, a heating furnace 10 is schematically shown by a rectangle 10 and a slab schematically shown by a rectangle 12 is illustrated just before a charge end 14 of the furnace 10. The slab 12 is charged into the furnace 10 through the charge end 14 and runs longitudinally in the furnace 10 toward a delivery end 16 thereof while it is heated as required. The heated slab is taken out from the furnace 10 throught the delivery end 16.

A conventional heat control method will now be described in conjunction with FIG. 1. It is assumed that the atmosphere filling the furnace 10 has a temperature $T_f$, the slab 12 has a temperature $T_{so}$ before its charge and an objective temperature $T_{s2}$ at the delivery end 16 and the slab 12 reaches its position shown by a rectangle labelled $T_{s1}$ within the furnace 10 after it has actually existed within the furnace for a time interval $\Delta t_1$. Under the assumed conditions, the actual temperature $\overline{Tf}$ of the atmosphere may be expressed by $$\overline{Tf} = \frac{\Sigma\ (\text{sampled values of } Tf \text{ during } \Delta t_1)}{(\text{Number of Sampling periods during } \Delta t_1)} \quad (1)$$

Assuming that the slab 12 has a specific heat Cp, a specific gravity $\gamma$, a thickness H and a heat transfer coefficient $\alpha$, the mean temperature $Ts_1$ of the slab 12 at its position as described above may be expressed by $$Ts_1 = (\overline{Tf} - Tso)\left(1 - e - \frac{\alpha}{Cp\gamma H}\Delta t_1\right) + Tso \quad (2)$$

Furthermore, assuming that $\Delta t_2$ designates a time interval for which the slab 12 is moved from the abovementioned position to the delivery end 14 or a time interval for which the slab 12 is still left within the furnace 10, one can obtain an objective atmosphere's temperature Tfp required for the slab (12) to have the objective delivery temperature $Ts_2$ through the following expression:

$$Tfp = (Ts_2 - Ts_1) / \left(1 - e - \frac{\alpha}{Cp\gamma H}\Delta t_2\right) + Ts_1 \quad (3)$$

Then the flow rate of a fuel for the furnace is controlled so that the temperature of the atmosphere is equal to the objective magnitude thereof.

However, the conventional control method as described above has been disadvantageous in that the accuracy of the control is poor because the heat transfer coefficient $\alpha$ appearing in the expressions (2) and (3) is varied with the position and temperature of the slab 12 within the furnace 10, the particular temperature profile of the burnt gas etc. and is difficult to be treated as a constant. Also, the control method has not considered the influence of the number of slabs 12 disposed in each of the control zones of the furnace, and the actual control is effected by using different magnitudes set to the different slabs. This has also resulted in a low control efficiency.

The present invention contemplates the elimination of the disadvantages of the prior art practice as described above. According to the present invention, the heat input to a plurality of slabs is determined in each of the control zones of a heating furnace by utilizing an equation of the formal equilibrium held between the total heat input to each control zone and the total heat output therefrom and apportioned among the slabs in accordance with the positions and heat contents thereof to be added to previous heat content thereof to thereby determine the heat content of the slabs at the present time point. Then, regarding the fuel to be charged for any time interval from the present time point, the necessary heat input to each slab is calculated on the basis of the difference between an objective heat content of each slab after any time point and the heat content thereof at the present time point and the result is added to the necessary heat inputs which have been similarly calculated for the remaining slabs to thereby to determine the heat input to the slabs in an associated one of the control zones. By substituting the heat input thus determined into the equation of the thermal equilibrium, the required flow rate of the charged fuel is estimated. Then, the flow rate of the fuel is control to the estimated flow rate so that the slabs are controlled so as to be heated following an objective heat content curve or an objective temperature rise curve thereof.

Figure 2:
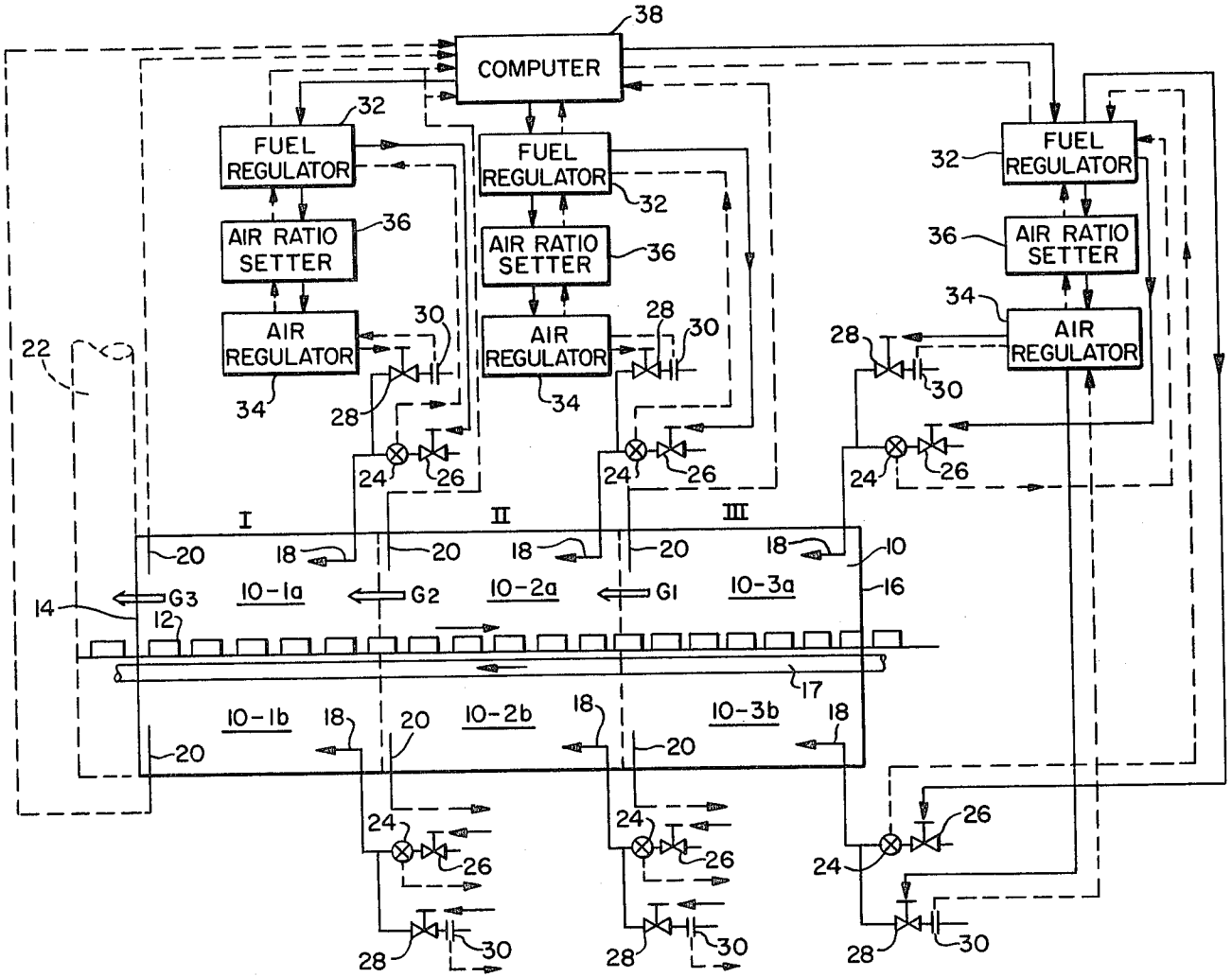
FIG. 2 is a schematic block diagram of a heating control apparatus for carrying out one embodiment according to the heating control method of the present invention.

Referring now to FIG. 2, there is illustrated a heating control apparatus for carrying out one embodiment according to the heating control method of the present invention. The arrangement illustrated comprises a continuously heating furnace schematically shown by a rectangle 10 and divided into three pairs of upper and lower control zones 10-1*a*, 10-1*b*, 10-2*a* and 10-2*b* and 10-3*a* and 10-3*b*. Each pair of upper and lower control zones is called hereinafter a control zone only for purposes of simplification. A plurality of slabs schematically shown by rectangles 12 are successively charged into the furnace 10 through a charge end 14 thereof and moved longitudinally through the furnace 10 in the order of the control zones III and II and I and along a skid pipe 17 disposed below a longitudinal array of spaced aligned slabs 12 until being heated as required. The heated slabs 12 are successively taken out from the furnace through a delivery end 16 thereof. The direction of movement of the slabs 12 is shown at the arrow denoted above one of the slabs 12.

Each of the control zones I, II or III includes a burner 18 and a temperature sensor 20 for an exhaust gas disposed therein adjacent each of the upper and lower walls of the furnace on the downstream and upstream sides respectively. An exhaust gas from the burner 18 flows through the associated control zone to oppose to the movement of the slabs 12 with exhaust gases from the control zone or zones located downstream thereof as shown at the arrows $G_1$, $G_2$ and $G_3$ in FIG. 2. Ultimately all the exhaust gases are exhausted through a flue 22.

The description will now be made in conjunction with the equation of the thermal equilibrium held in each of the control zones I, II or III as shown in FIG. 2 and, for example, the control zone i where i is equal to I, II or III.

(1) The total heat input to the control zone i may be expressed by $$\text{Total Heat Input} = V(i) \cdot Hg \tag{4}$$

where V(i) designates the flow rate of a fuel charged into the control zone i and Hg designates the calorific value per unit flow rate of the fuel.

(2) The fuel has a sensible heat expressed by $$\text{Sensible Heat of Fuel} = V(i) \cdot Cpf \cdot Tf \tag{5}$$

where Cpf designates the specific heat of the fuel per unit flow rate thereof and Tf designates a temperature at which the fuel is charged into the control zone i.

(3) Burning air has a sensible heat expressed by $$\text{Sensible Heat of Burning Air} = A(i) \cdot Cpa \cdot Ta \tag{6}$$

where Cpa designates the specific heat of burning air per unit flow rate of the fuel, Ta a temperature of the burning air, and A(i) designates a flow rate of air charged into the control zone i and may be expressed by $$A(i) = u(i) \cdot Ao \cdot V(i) \tag{7}$$

where u(i) is called an excess air coefficient and Ao designates a theoretical amount of air per unit flow rate of the mating fuel.

(4) The control zone i has exhaust gases flowing thereinto from control zones located downstream thereof and the exhaust gases have a heat quantity expressed by $$\text{Heat Quantity} = G(i+1) \cdot Cpg \cdot Tg(i) \tag{8}$$

where G(i+1) designates the flow rate of an exhaust gas flowing into the control zone i and may be expressed by $$G(i+1) = \sum_{k=1}^{i+1} [V(k)\{Go + Ao(u(k) - 1)\}] \tag{9}$$

where Go designates the theoretical amount of the exhaust gas per unit flow rate of the associated fuel. In the expression (8), Cpg designates the specific heat of the exhaust gas per unit flow rate of the mating fuel and Tg designates the temperature of the exhaust gas flowing into the control zone i.

In addition, the heat input to the control zone i includes the sensible heat of water contents in the air and fuel, scales, heat of formation etc., but such an additional heat input is negligibly small. As a result, the control zone i has the total heat input expressed by the sum of the expressions (4), (5), (6) and (8).

On the other hand, the control zone i delivers the total heat output including the following:

(1) The exhaust gas carries out heat expressed by $$\begin{aligned} &\text{Heat Carried Out by Exhaust Gas} \\ &= G(i) \cdot Cpg \cdot Tg(i) \\ &= Cpg \cdot Tg(i) \sum_{k=1}^{i} [V(k)\{Go + Ao(u(k) - 1)\}] \end{aligned} \tag{10}$$

(2) All the slabs located in the control zone i which are supplied with an heat input expressed by $$\text{Heat Input to Slabs} = Qts(i) \tag{11}$$

(3) The main body of the furnace 10 dissipates heat expressed by $$\text{Dissipation Heat from Furnace Body} = QL(i) = hL \cdot AL(Tws - TB) \tag{12}$$

where hL designates the heat transfer rate of the furnace body for dissipation heat, AL the surface area of the furnace body, Tws the surface temperature thereof and TB designates the ambient temperature. The dissipation heat from the furnace body is not so changed for a short time interval because of the fact that the furnace body is high in its heat capacity. Therefore, this dissipation heat can be considered as a constant.

(4) Cooling water dissipates heat Qw(i) expressed by $$\text{Dissipation Heat from Cooling Water} = Qw(i) = Gw \cdot Cpw \cdot \Delta Tw \tag{13}$$

where Gw designates the flow rate of cooling water, Cpw the specific heat of the cooling water and ΔTw designates the difference between an outlet and an inlet temperature of the cooling water. The difference in temperature can be also considered to be substantially constant.

In addition, scales carry out heat but this heat is negligibly small.

Accordingly, the control zone i delivers the total heat output expressed by the sum of the expressions (10), (11), (12) and (13).

Therefore, the equation of thermal equilibrium can be expressed by $$V(i) \cdot Hg + V(i) \cdot Cpf \cdot Tf + A(i) \cdot Cpa \cdot Ta + Cpg \cdot Tg(i+1) \cdot \sum_{k=1}^{i+1} [V(k)\{Go + Ao(u(k) - 1)\}] \cdot = Cpag \cdot Tg(i) \sum_{k=1}^{i} [V(k)\{Go + Ao(u(k) - 1)\}] + Q_{Ts(i)} + QL(i) + Qw(i) \tag{14}$$

By rearranging the expression (14) with respect to the charged fuel, the expression (14) is reduced to $$V(i) = \frac{(Cpg \cdot Tg(i) - Cpg \cdot Tg(i+1) \cdot \sum_{k=1}^{i+1} [V(k)\{Go + Ao(u(k) - 1)\}] + Q_{Ts(i)} + QL(i) + Qw(i)}{Hg + Cpf \cdot Tf + u(i) \cdot Ao + Cpg \cdot Tg(i)\{Go + Ao \cdot (u(i) - 1)\}} \tag{15}$$

Also, by combining the expression (14) with respect to the heat input to the slabs, it is reduced to $$Q_{Ts(i)} = V(i) \cdot [Hg + Cpf \cdot Tf + u(i) \cdot Ao + Cpg \cdot Tg(1) \{Go + Ao(u(i) - 1)\}] - (Cpg \cdot Tg(i) - Cpg \cdot Tg(i+1)) \cdot \sum_{k=1}^{i+1} [V(k)\{Go + Ao(u(k) - 1)\}] - QL(i) - Qw(i) \tag{16}$$

For a given heat input to the slabs $Q_{Ts(i)}$ required for the control zone i, the expression (15) is the fundamental expression for calculating the flow rate V(i) of the charged fuel while, for a given flow rate V(k) of the charged fuel, the expression (16) is the fundamental expression for calculating the heat input $Q_{T3(i)}$ to the slabs.

Then, a heat content Hsj of each slab can be determined as follows:

The expression (16) describes the heat input $Q_{Ts}$ to all the slabs in each of the control zones and that heat input is apportioned among those slabs in accordance with the heat contents and surface area as Asj of the respective slabs but is not apportioned uniformly. A rate of apportionment ηHj dependent upon the heat content can be estimated from the following expression:

$$\eta Hj = C_o + C_1 Hsj + C_2 Hsj^2 + C_3 Hsj^3 + C_4 Hsj^4 \tag{17}$$

where $C_0$, $C_1$, $C_2$, $C_3$ and $C_4$ are constants. Assuming that n slabs are present in the control zone i, the heat input to any slab j is determined by $$Qsj = \eta j Q_{Ts(i)} = \frac{\eta Hj Asj}{\sum_{k=1}^{n} \eta Hk \cdot Ask} \cdot Q_{Ts(i)} \tag{18}$$

Thus, the heat inputs to the slabs are determined by the expressions (17) and (18) and therefore, the heat content Hsj of the slab at the present time point is determined by $$Hsj = Hsj^o + Qsj/Voj \tag{19}$$

on the basis of a previous heat content $Hsj^o$ thereof where Voj designates the volume of the slab and γj designates the specific weight thereof.

The description will now be described in conjunction with the heating control method of the present invention employing the expressions (15), (16), (17), (18) and (19) as described above.

Referring back to FIG. 2, the upper burner 18 in each control zone is connected to a fuel sensor 24 for sensing the flow rate of the fuel and is connected to the fuel control valve 26 for controlling the flow rate of the fuel. That burner 18 is also connected to an air control valve 28 for controlling the flow rate of air and is connected to an air sensor 30 for sensing the flow rate of air. The fuel sensor 24 is then connected to a fuel regulator 32 for regulating the flow rate of the fuel while the air sensor 30 is connected to an air regulator 34 for regulating the flow rate of air. The air regulator 34 is connected to the fuel control valve 26 and also in two ways to the fuel regulator 32 through an air ratio setter 36. The air regulator 34 is further connected to the air control valve 26.

Also, the lower burner 18 in each control zone has the same connection as the upper burner 18 as shown typically in conjunction with the control zone III in FIG. 2.

Then, all the fuel regulators 32 are connected in two ways to an electronic computer 38 having connected thereto the temperature sensors 20 disposed in the control zones I, II and III respectively.

The temperature sensor 20 is disposed at the outlet of the associated control zone and always senses the temperature of the exhaust gas from the opposite burner 18. The regulators 32 and 34 deliver operating signals to the control valves 26 and 28 respectively to control valve opening degrees thereof. This results in the adjustment of low rates V and A of the fuel and air supplied to the associated burner 18. Also, the flow rate V of the fuel and that A of air are always sensed by the sensors 24 and 30 respectively and the sensed flow rates are supplied to the regulators 32 and 34 respectively.

The computer 38 receives data for the movement of the slabs, and sensed temperature signals from all the temperature sensors 20 and uses the expressions (15) through (19) to calculate and determine the flow rate of the fuel charged into each of the control zones from the received data and signals and an objective temperature rise curve of each slab stored therein. Then, the computer 38 applies the determined flow rates of the fuel to the associated fuel regulators 32 respectively.

The computer 38 has also stored therein the calorific value Hg of the fuel, the theoretical amount $A_o$ of air, the theoretical amount Go of the exhaust gas, the specific heat Cpa of air, the specific heat Cpf of the fuel, the specific heat Cpg of the exhaust gas, the objective temperature rise curve of each slab as described above, the dissipation heat QL from the furnace body, and the dissipation heat Qw from the cooling water. All the specific heats and the dissipation heats have been calculated as functions of a temperature.

Figure 3:
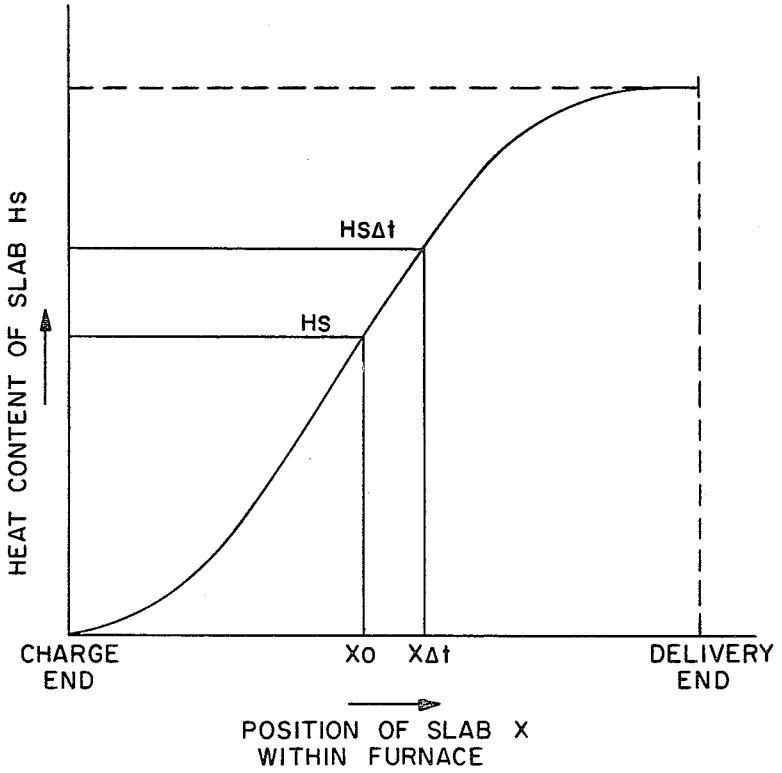
FIG. 3 is a graph illustrating an objective heat content curve of a slab.

The computer 38 is operated by various objective signals at predetermined equal time intervals of Δt. More specifically, the computer 38 uses the expression (16) to calculate and determine the heat input $Q_{Ts(i)}$ to the slabs in each control zone from the mean actual flow rate $\overline{V}(i)$ of the fuel, and the mean actual flow rate $\overline{A}(i)$ of air during the time interval Δt and the temperature Tg(i) of the exhaust gas from the temperature sensor 20 in the associated control zone. Then, the heat input $Q_{Ts(i)}$ to the slab is apportioned among the slabs in accordance with the heat content Hso(j) of each slab before the time interval Δt and following the expressions (18) and (19) to determine the heat content of each slab at the present time point. Subsequently, the flow rate of the charged fuel after the time interval Δt from the present time point is estimated as follows: As described above, the computer 38 has stored therein the objective temperature rise curve of each slab such as shown in FIG. 3 wherein there is illustrated the heat control Hs of a slab plotted in ordinate against the position x of the slab within the furnace in abscissa. Assuming that the slab is located at its position xo at the present time point, a slab's position xΔt after the time interval Δt is estimated from data for the movement of that slab. By using FIG. 3, a difference between an objective heat content HsΔt at the position xΔt and the heat content Hs at the present time point gives the calorific value Qs required during the time interval Δt. That is, the required calorific value Qs is determined by $$Qs = Vo \cdot \gamma \cdot (Hs\Delta t - Hs) \tag{20}$$

Then, the heat input $Q_{Ts(i)}$ to the slabs required for each control zone is calculated by $$Q_{Ts(i)} = \sum_{j=1}^{n} Qs(j) \tag{21}$$

By substituting the required heat input $Q_{Ts(i)}$ to the slabs into the expression (15), the flow rate V(i) of the fuel charged into each control zone. At that time, the temperature $T_{g(i)}$ of the exhaust gas is equal to the means actual magnitude thereof during the previous time interval Δt. As the expression (15) requires the flow rate of the charged fuel on the more downstream side, the calculation may preferably start with the most down stream control zone. This permits all the calculations to be successively made.

Upon the completion of the calculations as described above, the computer 38 applies set signals for the flow rates thus determined to the associated fuel regulators 32 which, in turn, operate the associated fuel control valves 26 respectively. Therefore, the flow rate of the fuel is adjusted in each control zone. At the same time, the fuel regulator 32 supplies these set signals to the air ratio setter 36 which, in turn, determines such an air ratio that the interior of the furnace is most suitably heated. The air regulator 34 controls the air control valve 28 for each control zone in response to the air ratio applied thereto to adjust the flow rate of air supplied to the associated burner 18.

From the foregoing it is seen that the present invention can control the temperature of slabs at a deliver end of a furnace with a high accuracy because the heating value directly balances the heat input without using a heat transfer coefficient previously employed with a temperature calculation. Also, unlike conventional methods of controlling the temperature within the furnace, the flow rates of the fuel and air are set at each of predetermined equal time intervals of Δt to always maintain a good heating state within the furnace because streams of the fuel and air are not varied during such a time interval.

While the present invention has been described in conjunction with a single preferred embodiment thereof, it is to be understood that numerous changes and modifications may be resorted to without departing from the spirit and scope of the present invention. For example, the present invention is applicable to any desired number of control zones into which an associate furnace is divided and also to a variety of workpieces to be heated.

What is claimed is:

1. For use with a continuously heated furnace divided into a plurality of control zones, wherein each of said plurality of zones has: a fuel flow rate sensor for sensing the flow rate of a charged fuel, an air flow rate sensor for sensing the flow rate of charged air, and a temperature sensor for sensing the temperature of an exhaust gas at a predetermined point in time, a control method for heating a plurality of slabs and comprising the steps of:

sensing the charged fuel flow rate and the charged air flow rate and the exhaust gas temperature at a predetermined point in time for each of said control zones;

calculating the heat input to each slab from the equations:

$$V(i) = \frac{(Cpg \cdot Tg(i) - Cpg \cdot Tg(i+1) \cdot}{Hg + Cpf \cdot Tf + u(i) \cdot}$$

-continued $$\frac{\sum_{k=1}^{i+1} [V(k)\{Go + Ao(u(k) - 1)\}] + Ao + Cpg \cdot Tg(i)\}Go + Ao \cdot \frac{Q_{Ts(i)} + QL(i) + Qw(i)}{(u(i) - 1)\}}}{}$$

and $$Q_{Ts(i)} = V(i) \cdot [Hg + Cpg \cdot Tf + u(i) \cdot Ao + Cpg \cdot Tg(1) \{Go + Ao(u(i) - 1)\}] - (Cpg \cdot Tg(i) - Cpg \cdot Tg(i + 1)) \cdot \sum_{k=1}^{i+1} [V(k)\{Go + Ao(u(k) - 1)\}] - QL(i) - Qw(i)$$

wherein:

V(i)—Calc. flow rate of charged fuel in zone i
V(k)—given flow rate of charged fuel in zone k
Hg—calorific value per unit flow rate of the fuel
Cpf—specific heat of the fuel per unit flow rate
Cpg—specific heat of exhaust gas per unit flow rate
Tf—temperature of fuel
Tg(i)—temperature of exhaust gas at zone i
u(i)—excess air coefficient at zone i
Ao—theoretical amount of air per unit flow rate of fuel
Go—theoretical amount of exhaust gas per unit flow rate of fuel
QL(i)—heat dissipation from furnace body in zone i
Qw(i)—heat dissipation from cooling water in zone i
$Q_{TS(i)}$—heat input to slab at zone i;

calculating the heat content to each slab from the equations:

$$\eta Hj - C_o - C_1 Hsj + C_2 Hsj^2 + C_3 Hsj^3 + C_4 Hsj^4$$

$$Qsj = \eta j Q_{Ts(i)} = \frac{\eta HjAsj}{\sum_{k=1}^{n} \eta Hk \cdot Ask} \cdot Q_{Ts(I)}$$

$$Hsj = Hsj^o + Qsj/Voj$$

wherein:

ηHj—rate of apportionment
$C_0$, $C_1$, $C_2$, $C_3$, $C_4$—constants
n—number of slabs in zone i
Qsj—heat input to slab j
Hsj—heat content of slab j at present time
$Hsj^o$—previous heat content of slab j
Voj—volume of slab j
γj—specific weight of slab j;

estimating a heat input to said slabs required up to the next succeeding time point from the difference between said determined heat input and an objective heat input to said slab using the equations:

$$Qs = Vo \cdot \gamma \cdot (Hs\Delta t - Hs)$$

$$Q_{Ts(i)} = \sum_{j=1}^{n} Qs(j)$$

wherein Δt is the time internal between the present time and said next succeeding time;

estimating a flow rate of said charged fuel by substituting values in the aforesaid equations;

controlling said flow rate of said charged fuel so as to be equal to said estimated flow rate for each of said zones.

* * * * *